United States Patent [19]

Burrows et al.

[11] Patent Number: 4,857,450

[45] Date of Patent: Aug. 15, 1989

[54] SILVER HALIDE PHOTOGRAPHIC MATERIALS

[75] Inventors: Ronald W. Burrows, Harlow; Keith A. Penfound, Walden; Bernard A. Lea, London, all of England

[73] Assignee: Minnesota Mining and Manufacturing Company, St. Paul, Minn.

[21] Appl. No.: 43,172

[22] Filed: Apr. 27, 1987

[30] Foreign Application Priority Data

Apr. 28, 1986 [GB] United Kingdom ..... 8610382

[51] Int. Cl.[4] ..... G03C 1/02; G03C 1/06

[52] U.S. Cl. ..... 430/603; 430/570; 430/575; 430/591; 430/592; 430/604; 430/605

[58] Field of Search ..... 430/604, 605, 570, 575, 430/591, 592, 603

[56] References Cited

U.S. PATENT DOCUMENTS

| | | | |
|---|---|---|---|
| 2,860,984 | 11/1958 | Jones | 430/592 |
| 3,520,693 | 7/1970 | Götze et al. | 430/592 |
| 3,790,390 | 2/1974 | Shiba et al. | 430/592 |
| 4,160,669 | 7/1979 | Habu et al. | 430/945 |
| 4,173,483 | 11/1979 | Habu et al. | 430/575 |
| 4,469,785 | 9/1984 | Tanaka et al. | 430/591 |
| 4,520,098 | 5/1985 | Dickerson | 430/570 |

FOREIGN PATENT DOCUMENTS

| | | |
|---|---|---|
| 52-18310 | 2/1977 | Japan . |
| 1367700 | 9/1974 | United Kingdom . |

*Primary Examiner*—Mukund J. Shah

*Attorney, Agent, or Firm*—Donald M. Sell; Walter N. Kirn; Mark A. Litman

[57] ABSTRACT

High contrast negative acting silver halide emulsions suitable for laser scanning applications comprising a Group VIII metal compound and one or more spectrally sensitizing dyes of the formula (I)

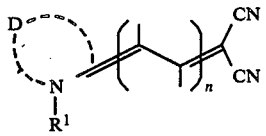

(II)

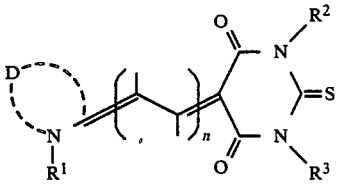

The emulsions have good long term stability and good sensitivity.

20 Claims, No Drawings

SILVER HALIDE PHOTOGRAPHIC MATERIALS

FIELD OF INVENTION

This invention relates to photographic elements comprising silver halide emulsions and in particular to high contrast negative acting photographic elements.

BACKGROUND TO THE INVENTION

High contrast photographic elements find particular utility in the graphic arts in which images are recorded in the form of half-tone dots. Exposure is conducted in a camera through a half-tone screen. The original is illuminated on the copy board of the camera by a high intensity light source such as pulsed xenon or quartz-iodine. A high photographic contrast is a requirement for accurate recording of half-tone images where it is desirable that exposure will generate either a full response or zero response.

Photographic elements for laser scanner imaging are designed to be imaged by electronically-modulated high resolution raster scanners, which scan the film with a very small spot of light from a high intensity source. Examples of high intensity sources include (i) gas lasers, especially argon ion, emitting at 488 nm, helium-neon, emitting at 633 nm, or helium-cadmium, emitting at 442 nm, (ii) near-infrared (NIR) laser diodes, which may emit light in the range 750–1500 nm, and (iii) light-emitting diodes (LED), which may emit in either the visible or NIR range. In all cases, the spot is scanned very rapidly, so that the dwell time on any part of the photographic element is short, typically from $10^{-7}$ to $10^{-6}$ seconds.

Silver halide photographic films usually respond optimally to exposures of duration of from 1 to 100 milliseconds, and tend to perform relatively badly under microsecond exposures, losing up to 1.0 logE in speed and 50% in average contrast. This is due to the phenomenon of high intensity reciprocity failure (HIRF), which also gives rise to related problems, such as:

(i) intermittency effects, which cause multiple superimposed short exposures to have a progressively greater effect as the time interval separating them is increased from microseconds to milliseconds or longer, (ii) latent image progression, whereby the latent image gives a stronger developed image when there is a delay period, especially of up to 1 hour, between exposure and development, (iii) unusually high sensitivity to development conditions, e.g. state of exhaustion of the developer.

It is desirable to overcome all these problems by making a photographic element which does not suffer from HIRF and thus responds equally to any given amount of exposure, regardless of how short or fragmented a form in which the exposure may be delivered.

It is known to prepare photographic emulsions containing small quantities of some Group VIII noble metal compounds. These metal compounds impart different properties to the emulsions, some compounds reduce HIRF and others may increase contrast For example, U.S. Pat. Nos. 3,790,390 and 4,147,542 disclose photographic emulsion containing at least one compound belonging to Group VIII together with particular sensitising dyes. Such dopants are advantageously added during the crystal growth stages of emulsion preparation, i.e. during initial precipitation, and/or during physical ripening of the silver halide crystals. Halide compounds of rhodium and iridium are the dopants most commonly used in this way. When such dopants are incorporated into conventional, negative working photographic emulsions, certain specific photographic effects are obtained, depending on the particular compound employed.

For example, hexachloroiridate complex salts of formula $M_3IrCl_6$ or $M_2IrCl_6$ (where M is a Group I metal), are incorporated as emulsion dopants with consequent improvement in sensitivity to high intensity exposure, and reduction in the desensitisation usually caused by mechanical stress. This phenomenon is disclosed, for example, in British Pat. Nos. 1 527 435 and 1 410 488, U.S. Pat. Nos. 4,126,472 and 3,847,621, German Pat. DE No. 3 115 274, and French Pat. No. 2 296 204.

The action on silver halide emulsions of halide compounds of rhodium is altogether different. These compounds produce the effect of increasing the contrast of the developed image, together with overall desensitisation of the emulsion. Rhodium doping is disclosed in a number of patents, e.g. rhodium trichloride in British Pat. No. 775 197, sodium hexachlororhodate in British Pat. No. 1 535 016; potassium hexachlororhodate in British Pat. No. 1 395 923; ammonium hexachlororhodate (III) in British Pat. No. 2 109 576 and U.S. Pat. No. 3,531,289, and rhodium chloride or trichloride in German Pat. Nos. DT 2 632 202A, DE 3 122 921 and Japanese Application No. 74-33781.

Silver halide emulsions doped with Group VIII metal compounds suffer from the disadvantage of instability of speed and contrast upon ageing. U.S. Pat. No. 3,488,709 discloses the addition of cadmium salts to rhodium containing silver halide emulsions as a stabilizer. Japanese Pat. Publication No. 52-18310 discloses stable silver halide emulsions containing rhodium salts in combination with spectral sensitizing dyes having an oxidation potential (Eox) greater than 0.79V. It is stated that the oxidation potentials of spectral sensitising dyes cannot be inferred from similarity of their structural formula. For example even if only one substituent is different, the oxidation potentials may differ considerably. The art therefore does not provide any indications of which types of organic molecules are liable to be useful as spectral sensitising dyes.

We have now found a class of structurally related compounds which are powerful sensitisers in silver halide emulsions doped with Group VIII metal compounds and impart good stability properties to the emulsion. In particular the dyes have proved useful with silver halide containing diffusion transfer printing plates and silver halide emulsions suitable for laser exposure.

SUMMARY OF THE INVENTION

Therefore, according the present invention there is provided a photographic silver halide emulsion containing a Group VIII metal compound and a sensitising amount of a compound of the general formula:

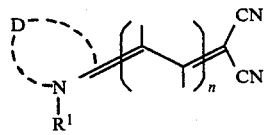

(I)

or

-continued (II)

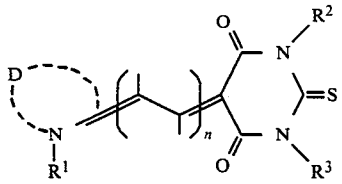

in which:

n is 0, 1 or 2 preferably 1 or 2;

$R^1$ *represents an alkyl group of* 1 to 4 carbon atoms, a carboxyalkyl group of 1 to 4 carbon atoms or a sulphoalkyl group of 1 to 4 carbon atoms;

$R^2$ and $R^3$ independently represent an alkyl group of 1 to 12 carbon atoms, an alkenyl group of 2 to 12 carbon atoms, an aryl group of up to 15 carbon atoms or an aralkyl group of up to 15 carbon atoms;

the free bonds on the chain may be satisfied by hydrogen or any chain substituent known in the cyanine dye art, such as lower alkyl groups of 1 to 5 carbon atoms, aryl and heteroaryl groups or two or more chain substituents together with the carbon atoms to which they are attached form a 5- or 6- membered carbocyclic ring, e.g. cyclopentyl;

D represents the non-metal atoms necessary to complete a heterocyclic nucleus containing 5 or 6 atoms in the heterocyclic ring, the nucleus optionally possessing substituents which may optionally be fused to the heterocyclic ring as is known in the cyanine dye art.

Preferably, the heterocyclic ring is composed of ring atoms selected from C, N, O, S and Se. Examples of heterocyclic nuclei include:

the thiazole series, e.g., thiazole, 4-methylthiazole, 4-phenylthiazole, 5-methylthiazole, 5-phenylthiazole, 4,5-dimethylthiazole, 4,5-diphenyl-thiazole, 4-(2-thienyl)-thiazole, the benzothiazole series, e.g. benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, the naphthothiazole series, e.g. naphtho[1,2]thiazole, naphtho[2,1]thiazole, 5-methoxynaphtho-[2,1]thiazole, 5-ethoxynaphtho[2,1]thiazole, 8-methoxynaphtho[1,2]-thiazole, 7-methoxynaphto[1,2]thiazole, the thianaphtheno-7',6',4,5-thiazole series, e.g. 4'-methoxythianaphtheno-7',6',4,5-thiazole, the oxazole series, e.g. 4-methyloxazole, 5-methyloxazole, 4-phenyloxazole, 4,5-diphenyloxazole, 4-ethyloxazole, 4,5-dimethyloxazole, 5-phenyloxazole, the benzoxazole series, e.g. benzoxazole, 5-chlorobenzoxazole, 5-methylbenzoxazole, 5-phenylbenzoxazole, 4,5-dimethylbenzoxazole, 5-methoxybenzoxazole, 5-ethoxybenzoxazole, 5-chlorobenzoxazole, 6-methoxybenzoxazole, 5-hydroxybenzoxazole, 6-hydroxybenzoxazole, the naphthoxazole series, e.g. naphtho[1,2]oxazole, naphtho[2,1]oxazole, the selenazole series, e.g. 4-methylselenazole, 4-phenylselenazole, the benzoselenazole series, e.g. benzoselenazole, 5-chlorobenzoselenazole, 5-methylbenzoselenazole, 5-methoxybenzoselenazole, 5-hydroxybenzoselenazole, tetrahydrobenzoselenazole, the naphthoselenazole series, e.g. naphtho[1,2-]selenazole, naphtho[2,1]selenazole, the thiazoline series, e.g. thiazoline, 4-methylthiazoline, the quinoline series, e.g. quinoline, 3-methylquinoline, 5-methylquinoline, 7-methylquinoline, 8-methylquinoline, 6-chloroquinoline, 8-chloroquinoline, 6-methoxy-quinoline, 6-ethoxyquinoline, 6-hydroxyquinoline, 8-hydroxyquinoline, the isoquinoline series, e.g. isoquinoline, 3,4-dihydroisoquinoline, the benzimidazole series, e.g. 1,3-diethylbenzimidazole, 1-ethyl-3-phenylbenzimidazole, the 3,3-dialkylindolenine series, e.g. 3,3-dimethylindolenine, 3,3,5-trimethylindolenine, 3,3,7-trimethylindolenine, the pyridine series, e.g. pyridine and 5-methylpyridine.

Preferred dyes of Formula (II) are

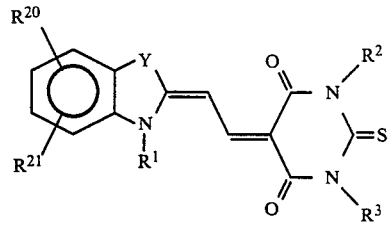

in which:

$R^1$, $R^2$, and $R^3$ are as defined above,

Y represents S, O, CH=CH, $NR^7$, Se, $CR^8R^9$, preferably S, O or $CR^{8R9}$, $R^7$ represents an alkyl group of 1 to 4 carbon atoms which may be substituted, e.g. acetoxyalkyl $R^8$ and $R^9$ independently represent a lower alkyl of 1 to 4 carbon atoms $R^{20}$ and $R^{21}$ independently represent a hydrogen or halogen atom, e.g. chlorine, bromine, iodine, a lower alkyl group of 1 to 5 carbon atoms e.g. methyl, ethyl, and alkoxy group of 1 to 5 carbon atoms, e.g. methoxy, ethoxy, an aryl group of up to 7 carbon atoms, e.g. phenyl and aryloxy group of up to 7 carbon atoms e.g. phenoxy or $R^{20}$ and $R^{21}$ together represent the necessary atoms to form an aromatic or unsaturated or saturated 5 or 6 membered carbocyclic or heterocyclic ring e.g. a methylenedioxy ring. Preferred dyes of Formula (I) are of the formula

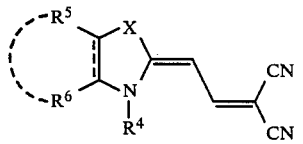

in which:

$R^4$ represents an alkyl group of 1 to 4 carbon atoms, or a carboxyalkyl group of 1 to 4 carbon atoms or a sulphoalkyl group of 1 to 4 carbon atoms $R^5$ and $R^6$ independently represent hydrogen, an alkyl group of 1 to 5 carbon atoms, an aryl group of up to 7 carbon atoms, or $R^5$ and $R^6$ together represent the necessary atoms to form a carbocyclic aromatic ring which ring may carry substituents $R^{20}$ and $R^{21}$ defined above.

X represents S, $NR^7$, —CH=CH— or Se,---represents a single or double bond

Preferably X is S and the dyes are of the formula:

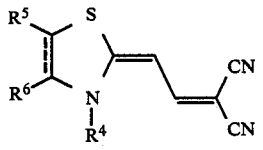

The photographic emulsions of the invention have surprisingly good long term stability and the sensitising dyes give unexpectedly good sensitivity. Whilst the sensitising dyes are known in the art amongst the myriad of dyes used in conventional photographic emulsions and are disclosed for example in British Pat. Specification Nos. 555 936, 786 169, 789 136 and U.S. Pat. Nos. 2,078,233, 2,165,338, 2,170,803, 2,519,001, 2,548,571, 2,860,981 and 2,860,982, there is no indication in the art that the dyes used in the invention would impart such particularly effective sensitisation and stability properties to high contrast emulsions doped with Group VIII metal compounds. Heretofore the dyes used in the invention are not known to have been used in such emulsions.

The photographic emulsions used in the present invention may comprise of any of the conventional silver halides e.g. silver chloride, silver bromide, silver chlorobromide, silver iodobromide, silver chloroiodobromide etc.. Emulsions containing at least 30 mole percent silver chloride are preferable with emulsions containing at least 60% chloride being most preferred. Preferably the emulsions are silver chlorobromide emulsions. The silver salts may be in the form of coarse grains or fine grains in the cubic crystal system or octahedral crystal system or a crystal system that is a mixture of the two, or they may be of some other crystal system.

The photographic emulsions are generally formed by precipitation by conventional methods, e.g. by the single jet method or by the double jet method. The emulsions may be of uniform grain shape and grain size, may have a wide range of grain size distribution, or may comprise a mixture of emulsions of two or more kinds. Methods for the preparation of silver halide emulsions are disclosed for example in C.E.K. Mees "The Theory of the Photographic Process", 1966, 3rd edition, p. 31–44, MacMillan Co., New York; P.Glafkides "Chimie Photographique", 1967, 2nd edition, p.251–308; Photocinema Paul Montel, Paris etc.

The Group VIII metals of the Periodic Table include iron, cobalt, nickel, ruthenium, rhodium, palladium, osmium, iridium and platinum. The mode of action of these compounds is not always predictable. Some may enhance contrast, others better control HIRF. Compounds containing these metals which are most preferably used in the present invention are ruthenium, iron, iridium and rhodium compounds, most preferably ruthenium and rhodium. Examples of the Group VIII metal compounds useful in this invention, include ferrous sulfate $FeSO_4.5H_2O$; ferric chloride $FeCl_3$; potassium hexacyanoferrate(II)$K_4Fe(CN)_6.3H_2O$; potassium hexacyanoferrate (III) $K_3Fe(CN)_6$; cobaltous chloride $CoCl_2$; cobaltous nitrate $Co(NO_3)_2.6H_2O$; potassium hexacyanocobaltate (III) $K_3Co(CN)_6$; nickel (II) chloride $NiCl_2.6H_2O$; nickel (II) nitrate $Ni(NO_3)_2.6H_2O$; ruthenium (III) chloride $RuCl_3$; potassium hexachlororuthenate (IV) $K_2RuCl_6$; potassium aquopentachlororuthenate $K_2RuCl_5.H_2O$; rhodium (III) chloride $RhCl_3.4H_2O$; ammonium hexachlororhodate (III) $(NH_3)_3RhCl_6$; sodium hexachlororhodate $Na_3RhCl_6.12H_2O$; palladium (II) chloride $PdC1_2$; palladium (II) nitrate $Pd(NO_3)_2$; palladium (II) bromide $PdBr_2$; potassium hexachloropalladate (IV) $K_2PdCl_6$; osmium (II) chloride $OsCl_2$; iridium (III) chloride $IrCl_3$; iridium (IV) chloride $IrC1_4$; iridium (III) bromide $IrBr_3.4H_2O$; iridium (IV) bromide $IrBr_4$; potassium hexachloroiridate (III) $K_3IrCl_6$; potassium hexachloroiridate (IV) $K_2IrCl_6$; ammonium hexachloroplatinate (IV) $(NH_4)_2PtCl_6$; potassium hexachloroplatinate (IV) $K_2PtCl_6$; ammonium hexabromoplatinate (IV) $(NH_4)_2PtBr_6$; and the like. These Group VIII metal compounds are generally used in an amount of $10^{-9}$ mol to $10^{-3}$ mol per 1 mol of silver halide, independently or in combinations of more than one of these compounds. A gold compound can be preferably added to the emulsion in combination with any of those compounds of the Group VIII metal. The addition of these compounds is properly conducted at the formation of the silver halide grains, at the start of the ripening of the emulsion or in the course thereof in the production of the silver halide emulsion.

The sensitizing dyes used in the present invention are generally used in an amount of $10^{-5}$ to $10^{-2}$ mole per mole of silver halide contained in the silver halide emulsion, either separately or in combinations of more than one of them. The addition of the sensitizing dyes to the emulsion is carried out in the same manner as the aforesaid metal compounds. They may be added to the emulsion simultaneously with the said metal compounds, or may be added independently regardless of the order.

The photographic emulsions of the invention may be coated on an opaque or transparent base to provide high contrast black and white photographic elements which are suitable for use in laser imaging and graphics art camera speed applications. Examples of bases are plastics film e.g. polyester film, biaxially orientated polyethylene-terephthalate film, vesicular polyester film, titanium dioxide pigmented film and photographic grade base paper e.g. baryta coated paper.

The emulsions may also be used as the light sensitive medium in photosensitive printing plates. Examples of photosensitive printing plates are disclosed in U.S. Pat. No. 4,361,635 which comprises a silver halide diffusion transfer system. Photographic sheets capable of silver salt diffusion transfer development to form lithographic printing plates comprise a support having a silver halide emulsion layer and a receptor layer over the emulsion layer, the receptor layer comprising a high molecular weight hydrophilic polymer, the major proportion thereof being a polyaldehyde and catalytic nuclei for silver salt diffusion transfer development. After conventional exposure and diffusion transfer development, the receptor layer contains metallic silver image areas thereon which are ink receptive, and which allow the use of the structure as a lithographic plate. Dyes of general formula (I) have proved to be particularly beneficial in laser exposed diffusion transfer formulations.

The photosensitive emulsions may be developed in rapid access developers and thereafter fixed in the normal manner. Subsequently they may be washed and dried. Processing may be undertaken in 90 secs.

Preferred sensitising dyes for use in the invention include:

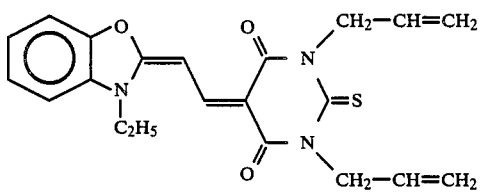
Dye 1

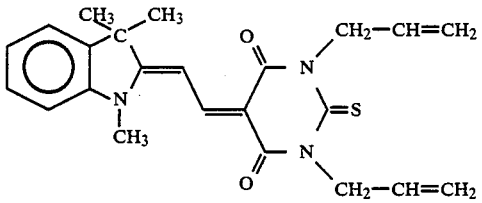
Dye 2

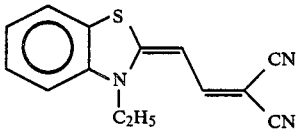
Dye 3

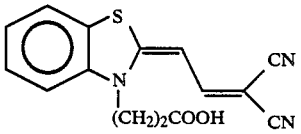
Dye 4

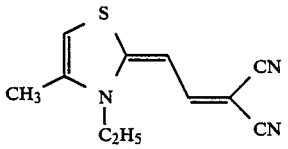
Dye 5

Other dyes of the invention are reported in the following Table 1.

TABLE 1

| Dye No. | General Formula | D completes | $R^1$ | n | $R^2$ | $R^3$ | WAVELENGTH OF MAXIMUM SENSITIVITY (nm) |
|---|---|---|---|---|---|---|---|
| 6 | II | benzothiazole | $C_2H_5$ | 1 | $CH_2{=}CH{-}CH_2{-}$ | $CH_2{=}CH{-}CH_2{-}$ | 540 |
| 7 | II | thiazoline | $CH_3$ | 1 | $CH_2{=}CH{-}CH_2{-}$ | $CH_2{=}CH{-}CH_2{-}$ | 470 |
| 8 | I | 5,6-dichloro-3-ethyl-benzimidazole | $C_2H_5$ | 1 | — | — | 465 |
| 9 | I | quinoline-2 | $C_2H_5$ | 1 | — | — | 505 |

Suitable synthetic routes for the preparation of the dyes are disclosed in British Pat. Specification No. 555 936 and U.S. Pat. Nos. 2,860,981, 2,548,571 and 2,170,803.

The following well known dye disclosed in U.S. Pat. No. 2,493,748 was used as comparison in the Examples.

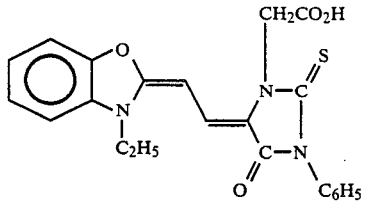
Dye A

The invention will now be illustrated by the following Examples.

EXAMPLE 1

Preparation of Dye 5

48 g of 2:4 dimethylthiazole (0.4M) and 80 g ethyl toluene 4-sulphonate (0.4M) were mixed and heated in an oil bath at 140° C. for 4 to 6 hours. The quaternary salt solidified on cooling. 84 g of 2-acetanilino 1:1-dicyano-ethylene (0.4M), and 2 liter of ethanol were added, the mixture heated on a steam bath and, a solution was obtained.

56 ml of triethylamine were slowly added and the mixture refluxed for 30 minutes. The mixture was cooled in a refrigerator for at least 20 hours and filtered, 45 to 50 g of dye being collected. The dye was recrystallized from ethanol (1.5 to 2 liter) allowing dye to crystallize overnight, yielding 40 g of dye.

Characterisation

Yellow/brown needles with blue reflex. Melting point=156° C. λmax (methanol)=449 nm. $\epsilon=5.8\times10^4$. Eox+1.1V.

EXAMPLE 2

Spectral sensitisation of a camera speed Graphic Arts negative lithographic silver halide film suitable for rapid access development.

The silver halide emulsion used was a 64% chloride/36% bromide with an average grain size of about 0.2 micron, prepared by a double-jet emulsification under controlled pAg conditions. 0.5 micromoles of a rhodium dopant ($Na_3RhCl_6.12H_2O$) per mole of silver halide was incorporated into the crystals during emulsification, to impart high contrast under rapid access processing conditions. Chemical sensitisation was achieved with a combination of sulphur and gold sensitisers ($Na_2S_2O_3.5H_2O$ $1.25\times10^{-4}$ moles per mole Ag and $NaAuCl_4.2H_2O$ $8\times10^{-5}$ moles per mole Ag) and the emulsion was stabilised with a tetraazaindene stabiliser.

The sensitising dyes were added as 0.2% solutions with either methanol or methanol/dimethylformamide mixtures as solvents. Additions of a surfactant (Triton X-200, commercially available from Rohm and Haas)

and formaldehyde (hardener) were made, pH adjusted to 5.5 and the emulsions coated onto a subbed polyester film base to give a silver coating weight of 4 g/m$^2$. The emulsion layer was overcoated with a protective gelatin layer.

The coatings were exposed with a xenon flash tube (Braun F910 Professional Flash Unit) through a 489 nm band pass interference filter and a 0–4 continuous wedge with exposure times of 5 milliseconds.

After exposure the coatings were developed in 3M type RDC II rapid access developer (commercially available from Minnesota Mining & Manufacturing Company) for 20 secs at 40° C., fixed in 3M RF fixer (commercially available from Minnesota Mining & Manufacturing Company) for 20 secs at 40° C. then washed and dried. The processing time was 90 secs.

The emulsion coatings were evaluated for sensitivity, wavelength of peak sensitivity (λ max) and ageing stability under ambient storage conditions. The stability of the coatings was assessed by determining the changes in Dmin, relative sensitivity, (logS) (measured at 0.1 above Dmin) and contrast (CON) (measured between 0.5 and 2.5 above Dmin) that occurred during the ageing period. The results are reported in Table 2.

TABLE 2

| Dye | CONCENTRATION mole of dye/mole Ag | Eox | λ max | INITIAL Dmin | log S | CON | CHANGE OF AGEING Δ Dmin | Δ log S | Δ CON | AGEING PERIOD |
|---|---|---|---|---|---|---|---|---|---|---|
| 1 | $5 \times 10^{-4}$ | +0.98 V | 500 nm | 0.04 | 1.97 | 6.09 | +0.03 | +0.13 | −9% | 16 months |
| 2 | $7 \times 10^{-4}$ | +1.2 V | 530 nm | 0.06 | 1.91 | 6.09 | 0 | +0.15 | −16% | 16 months |
| 3 | $7 \times 10^{-4}$ | +1.1 V | 510 nm | 0.05 | 1.92 | 6.29 | +0.03 | +0.17 | −14% | 16 months |
| A | $3.5 \times 10^{-4}$ | +0.42 V | 540 nm | 0.05 | 1.70 | 8.13 | +0.11 | +0.68 | −47% | 16 months |
| 4 | $7 \times 10^{-4}$ | +1.0 V | 510 nm | 0.05 | 1.92 | 5.13 | +0.02 | +0.30 | −22% | 12 months |
| 5 | $7.5 \times 10^{-4}$ | +1.1 V | 490 nm | 0.06 | 1.88 | 4.88 | +0.02 | +0.22 | −15% | 12 months |
| A | $3.5 \times 10^{-4}$ | +0.42 V | 540 nm | 0.06 | 1.81 | 7.5 | +0.03 | +0.63 | −37% | 12 months |

The results clearly show that the dyes of the invention give significantly smaller changes in Dmin, sensitivity and contrast on ageing than the control dye A, thus demonstrating the ability of these dyes to produce a high contrast negative rapid access lithographic film with sensitisation that is stable over a considerable period.

As well as rhodium doped emulsions, similar beneficial results have been obtained with these dyes when sensitising ruthenium ($K_2RuCl_5.H_2O$) doped emulsions.

EXAMPLE 3

Spectral sensitisation of a high contrast rapid access material suitable for exposure on an Argon-ion laser scanner.

Two emulsion samples were prepared.

Sample A was similar to that described in Example 2 except that 0.1 micromoles of $Na_3RhCl_6.12H_2O$ was employed as a rhodium dopant and the emulsion was spectrally sensitised with Dye 5 ($1.38 \times 10^{-3}$ mole per mole Ag).

Sample B was similar to Sample A except the dopant comprised the combination of 0.1 micromole of $Na_3RhCl_6 12H_2O$ and 0.5 micromole of $K_3IrCl_6$ per mole of Ag.

The emulsions of Samples A and B were chemically sensitised with $Na_2S_2O_3.5H_2O$ ($2 \times 10^{-5}$mole per mole Ag) and $NaAuCl_4 2H_2O$ ($1.2 \times 10^{-5}$ mole per mole Ag).

The emulsions were coated onto a subbed polyester base backed with a gelatin layer containing an anti-halation dye absorbing at about 500 nm. The samples were imaged on both a Hell DC 350 scanner and a Crosfield Magnascan 640 IE yielding half-tone dots of good quality over the whole tonal range, after processing as in Example 2. There was no visible staining in the processed film.

The Dmin, Dmax and laser power for the samples exposed at 488 nm on the Crosfield Scanner are reported in the following Table. The scanner employed an exposure range of 32 steps and the intensity of the source was adjusted such that step 16 represented 50% dot. Laser power is the estimated power setting for this condition.

| Sample | Dmin | Dmax | laser power (mw) |
|---|---|---|---|
| A | 0.04 | 4.3 | 1.0 |
| B | 0.04 | 4.8 | 2.2 |

This Example demonstrates the use of materials of the invention for laser imaging applications, more especially imaging by an electronic scanner which produces half-tone images from continuous tone originals by means of electronic dot generation (EDG). Matching of the film maximum sensitivity and the laser emission at 488 nm is of prime importance for this application, and the peak sensitivities of Dyes 1, 3, 4 and 5 particularly well match the laser emission.

EXAMPLE 4

Spectral sensitisation of a photolithographic sheet capable of forming a lithographic printing plate upon imaging via a silver salt diffusion transfer step.

The material comprises a silver halide emulsion layer and an overlying receptor layer, comprising a high molecular weight hydrophilic polymer and catalytic nuclei for silver salt diffusion transfer development. When an imagewise exposed plate is contacted with the development solution, the exposed silver halide grains are reduced to silver metal, as in conventional development. The unexposed grains dissolve in the developer via formation of soluble silver complexes, such as complexes of silver thiosulphate and diffuse towards the receptor layer. When the soluble silver complex contacts development nuclei contained in the receptor layer, the silver is reduced to a metallic deposit. The deposit can then form the ink receptive image areas of a lithographic printing plate.

The rhodium doped silver halide emulsion component was essentially similar to that described in Example 2 except that the mean grain size was about 0.35 micron. The emulsion was spectrally sensitised with either Dye 1 or Dye 3 and incorporated into a lithographic plate constructions as described in U.S. Pat. No. 4,361,635.

The plates showed little change in sensitometry after incubation and both fresh and incubated plates performed well on the press.

The photolithographic plates were exposed by a tungsten lamp run at a colour temperature of 3200° K.

through a 488 nm narrow pass interference filter in an Eastman Kodak 101 sensitometer. The sensitivites (in relative log exposure units) of the lithographic plates spectrally sensitised with Dyes 1 and 3 are given below.

| DYE | SENSITIVITY AT 488 NM |
|---|---|
| 1 | 1.35 |
| 3 | 1.66 |

A plate spectrally sensitised with Dye 3 was incubated for 4 days at 120° F. (49° C.) and showed a D min increase of 0.1 density units and a sensitivity increase of 0.11 log exposure units.

EXAMPLE 5

SPECTRAL SENSITISATION OF AN EMULSION DOPED WITH A COMBINATION OF IRIDIUM AND RUTHENIUM

The silver halide emulsion used was a 64 mole per cent chloride/36 mole per cent bromide with an average grain size of 0.25 microns, prepared by a double-jet emulsification under controlled pAg conditions. 0.29 micromoles of a ruthenium dopant [$K_2RuCl_5.(H_2O)$-]and 0.24 micromoles of an iridium dopant ($K_3IrCl_6$) per mole of silver halide were incorporated into the crystals during emulsification. The emulsion was chemically sensitised with a combination of sulphur and gold sensitisers and stabilised with a tetrazaindene stabiliser.

The emulsion was spectrally sensitised with 250 mg of Dye 5 per mole of silver halide. Additions of a surfactant (TRITON X-200, commercially avaliable from Rohm and Haas) and formaldehyde were made, the pH was adjusted to 5.5. and the emulsion coated onto a subbed polyester film base to give a silver coating weight of 3.9 g/m$^2$. The emulsion layer was overcoated with a protective gelatin layer. A gelatin anti-halation layer containing a dye absorbing at 500 nm was applied to the polyester base on the side remote from the emulsion layer.

The coated material (Sample C) was exposed by an EG and G Company flash sensitometer for $10^{-5}$ seconds with a Eastman Kodak Wratten Number 4 filter and processed using the chemistry and conditions described in Example 2. The values of D min, D max, sensitivities (in relative log exposure units) measured at densities of 1.0 and 2.5 above D min, and contrasts measured between the densities 0.07 and 0.17 (CON 1) and between 1.6 and 4.0 (CON 2) are given below.

| | D min | D max | Sensitivity at D = 1.0 | Sensitivity at D = 2.5 | CON 1 | CON 2 |
|---|---|---|---|---|---|---|
| Sample C | 0.04 | 4.8 | 0.43 | 0.26 | 1.17 | 7.6 |

Specimens of Sample C stored at a temperature of 90° F. (32° C.) for 5 months were compared for changes in sensitometry with specimens of the Sample C kept under refrigerated conditions. Differences in D min, speed at a density of 2.5 above D min and contrast between densities 1.6 and 4.0, relative to the refrigerated sample are reported in the following Table.

-continued

| | D min | ΔS | ΔCON |
|---|---|---|---|
| Sample C stored at 90° F. (32° C.) for 5 months (relative to refrigerated sample) | 0 | +0.08 | −0.15 |

This example demonstrates the use of the dyes of the invention to sensitise emulsions doped with a combination of iridium and ruthenium complexes to produce stable, high contrast green sensitive materials.

EXAMPLE 6

The silver halide emulsion used was a cubic 64 mole percent chloride/36 mole percent bromide with an average grain size of about 0.2 microns, prepared by a double-jet emulsification under controlled pAg conditions. 0.25 micromoles of a rhodium dopant ($Na_3RhCl_6.12H_2O$) per mole of silver halide were incorporated into the crystals during emulsification. The emulsion was chemically sensitised with a combination of sulphur and gold sensitisers and stabilised with a tetraazaindene stabiliser.

Separate portions of the emulsion were spectrally sensitised (per mole of silver halide) with $6.3\times10^{-4}$ moles of Dye 3 (Sample D): $3.6\times10^{-4}$ moles of Dye A (Sample E) and $2.2\times10^{-4}$ moles of Dye B (Sample F).

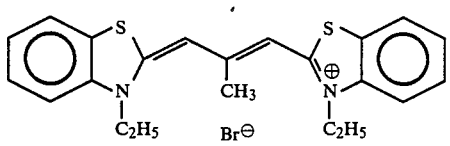

Dye B

Additions of a surfactant (TRITON X-200, commercially available from Rohm and Haas) and formaldehyde were made to each of the spectrally sensitised emulsion samples. The pH of the samples was adjusted to 5.5 before coating onto a subbed polyester film base to give a silver coating weight of 4g/m$^2$. The separate emulsion layers were each overcoated With a protective gelatin layer.

Specimens of Samples, D, E and F were incubated at 50° C. and 60% relative humidity for 7 days before exposure and processing. Both incubated and unincubated specimens were exposed to tungsten light attenuated with a daylight correction filter and a 0–4 continuous wedge for 10 seconds and processed using the chemistry and conditions described in Example 2. The exposed and processed coated specimens were evaluated for Dmin, relative log sensitivity (logS) (measured at 0.1 above Dmin) and contrast (CON) (measured between 0.5 and 2.5 above Dmin). The incubation stability of the coating was assessed by determining the changes in Dmin, relative log sensitivity and contrast that were brought about by the incubation treatment.

The results are reported in TABLE 3.

The results show clearly that the dye of the invention (Dye 3) exhibits significantly greater stability under the incubation conditions used than either of the reference dyes A or B.

TABLE 3

| SAMPLE | DYE | CONCENTRATION MOLE OF DYE /MOLE Ag | Eox | INITIAL DMIN | INITIAL Log S | INITIAL CON | CHANGE ON INCUBATION Δ Dmin | CHANGE ON INCUBATION Δ log S | CHANGE ON INCUBATION Δ CON |
|---|---|---|---|---|---|---|---|---|---|
| D | 3 | $6.3 \times 10^{-4}$ | +1.1 V | 0.04 | 1.22 | 5.91 | 0 | +0.39 | −17% |
| E Reference | A | $3.6 \times 10^{-4}$ | +0.42 V | 0.04 | 1.68 | 10.8 | +0.01 | +0.84 | −45% |
| F Reference | B | $2.2 \times 10^{-4}$ | +0.81 V | 0.05 | 1.71 | 8.86 | +0.02 | +0.94 | −41% |

We claim:

1. A photographic silver halide emulsion containing one or more Group VIII metal compound characterised in that the emulsion contains a sensitising amount in the range of $10^{-5}$ to $10^{-2}$ mole per mole of silver halide of a compound of the general formula:

(I)

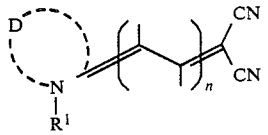

or (II)

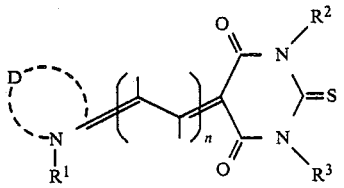

in which:

n is 0, 1 or 2;

$R^1$ represents an alkyl group of 1 to 4 carbon atoms, a carboxyalkyl group of 1 to 4 carbon atoms or a sulphoalkyl group of 1 to 4 carbon atoms;

$R^2$ and $R^3$ independently represent an alkyl group of 1 to 12 carbon atoms, an alkenyl group of 2 to 12 carbon atoms, an aryl group of up to 15 carbon atoms or an aralkyl group of up to 15 carbon atoms;

the free bonds on the chain may be satisfied by hydrogen or any chain substituent known in the cyanine dye art or two or more chain substituents together with the carbon atoms to which they are attached may form a 5- or 6-membered carbocyclic ring;

D represents the non-metal atoms necessary to complete a heterocyclic nucleus containing 5 or 6 atoms in the heterocyclic ring, the nucleus optionally possessing substituents which may optionally be fused to the heterocyclic ring.

2. A photographic silver halide emulsion as claimed in claim 1 characterised in that n is 1 or 2.

3. A photographic silver halide emulsion as claimed in claim 2 characterised in that $R^1$ is an alkyl group of 1 to 4 carbon atoms.

4. A photographic silver halide emulsion as claimed in claim 3 characterised in that D represents the necessary atoms to complete a thiazole, benzothiazole, naphthothiazole, thianaphtheno-7',6',4,5-thiazole, oxazole, benzoxazole, naphthoxazole, selenazole, benzoselenazole, naphthoselenazole, thiazoline, quinoline, isoquinoline, benzimidazole, 3,3-dialkylindolenine or pyridine nucleus.

5. A photographic silver halide emulsion as claimed in claim 1 characterised in that the compound is of the formula

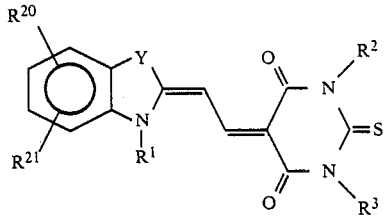

in which:

$R^1$, $R^2$ and $R^3$ are as defined in claim 1,

Y represents S, O, CH=CH, $NR^7$, Se or $CR^8R^9$, $R^7$ represents an alkyl group of 1 to 4 carbon atoms which may be substituted, $R^8$ and $R^9$ independently represent a lower alkyl of 1 to 4 carbon atoms $R^{20}$ and $R^{21}$ independently represent a hydrogen or halogen atom, a lower alkyl group of 1 to 5 carbon atoms, an alkoxy group of 1 to 5 carbon atoms, an aryl group of up to 7 carbon atoms, and aryloxy group of up to 7 carbon atoms $R^{20}$ and $R^{21}$ together represent the necessary atoms to form an aromatic or unsaturated or saturated 5 or 6 membered carbocyclic or heterocyclic ring e.g., a methylene dioxy ring,

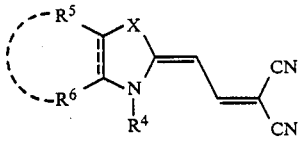

in which:

$R^4$ an alkyl group of 1 to 4 carbon atoms, or a carboxyalkyl group of 1 to 4 carbon atoms or a sulphoalkyl group of 1 to 4 carbon atoms, $R^5$ and $R^6$ independently represent hydrogen, and alkyl group of 1 to 5 carbon atoms and aryl group of up to 7 carbon atoms, or $R^5$ and $R^6$ together represent the necessary atoms to form a carbocyclic aromatic ring which ring may carry substituents $R^{20}$ and $R^{21}$ defined above, X represents S, $NR^7$, —CH=CH—or Se ---- represents a single or double bond.

6. A photographic silver halide emulsion as claimed in claim 5 characterised in that the compound is of the formula:

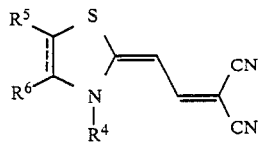

in which:

$R^4$ to $R^6$ are as defined in claim 5.

7. A photographic silver halide emulsion as claimed in claim 1 characterised in that the compound is selected from

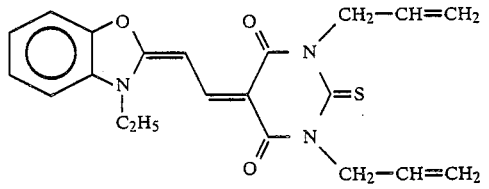

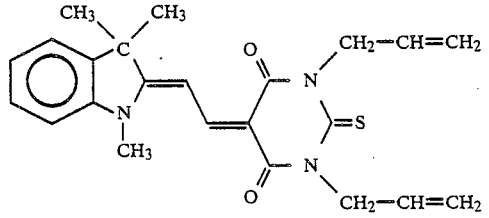

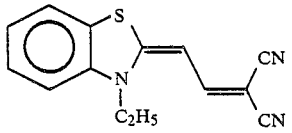

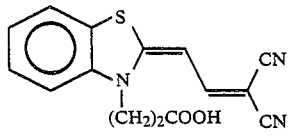

-continued

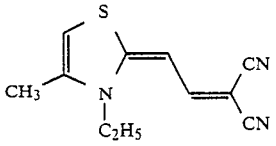

8. A photographic silver halide emulsion as claimed in claim 1 characterised in that the silver halide emulsion contains at least 60 mole % silver chloride.

9. A photographic silver halide emulsion as claimed in claim 1 in which the silver halide emulsion is a silver chlorobromide emulsion.

10. A photographic silver halide emulsion as claimed in claim 1 in which the Group VIII metal compound is selected from rhodium, ruthenium, and iridium compounds or the mixtures thereof.

11. A photographic silver halide emulsion as claimed in claim 1 in which the Group VIII metal compound is present in an amount in the range $10^{-9}$ mol to $10^{-3}$ mol per 1 mol of silver halide.

12. A photographic element comprising a base having coated thereon a layer of a photographic emulsion as claimed in claim 8.

13. A photographic element as claimed in claim 12 in which the base comprises an opaque or transparent material.

14. A photographic element as claimed in claim 12 in which the photographic element is in the form of a photosensitive printing plate.

15. A photographic element as claimed in claim 14 in which the photographic emulsion is in association with a receptor layer to form a silver salt diffusion transfer system.

16. A method of recording an image which comprises image-wise exposing and developing a photographic element as claimed in claim 12.

17. A method as claimed in claim 16 characterised in that a half-tone image is recorded by scanning with a small spot of light from a high intensity, the dwell time of the light on any part of the element being from $10^{-7}$ to $10^{-6}$ seconds.

18. A photographic silver halide emulsion as claimed in claim 4 characterised in that the silver halide emulsion contains at least 60 mole % silver chloride.

19. A photographic element comprising a base having coated thereon a layer of a photographic emulsion as claimed in claim 1.

20. A photographic element comprising a base having coated thereon a layer of a photographic emulsion as claimed in claim 4.

* * * * *

UNITED STATES PATENT AND TRADEMARK OFFICE

CERTIFICATE OF CORRECTION

PATENT NO. : 4,857,450

DATED : August 15, 1989

INVENTOR(S) : Burrows, Penfound and Lea

It is certified that error appears in the above-identified patent and that said Letters Patent is hereby corrected as shown below:

Column 3, line 12, "represents an alkyl group of" should be taken out of italics and in regular type.

Column 4, line 41, "$CR^{8R9}$" should be --$CR^{8}R^{9}$--.

Signed and Sealed this

Tenth Day of December, 1991

*Attest:*

HARRY F. MANBECK, JR.

*Attesting Officer*

*Commissioner of Patents and Trademarks*